United States Patent [19]

Elliott-Moore

[11] Patent Number: 5,073,067

[45] Date of Patent: Dec. 17, 1991

[54] MINE ROOF SUPPORT

[75] Inventor: Peter Elliott-Moore, Evesham, England

[73] Assignee: Meco Mining Equipment Limited, Ashchurch, England

[21] Appl. No.: 680,422

[22] Filed: Apr. 4, 1991

[30] Foreign Application Priority Data

May 2, 1990 [GB] United Kingdom ..... 9009859

[51] Int. Cl.[5] ..... E21D 15/44

[52] U.S. Cl. ..... 405/302; 405/291; 405/295

[58] Field of Search ..... 405/290–302; 91/170 MP; 299/31, 33

[56] References Cited

U.S. PATENT DOCUMENTS

| | | | |
|---|---|---|---|
| 3,530,490 | 9/1970 | Ward et al. | 405/302 X |
| 4,191,498 | 3/1980 | Weirich et al. | 405/302 |
| 4,264,237 | 4/1981 | Irresberger et al. | 405/302 |
| 4,473,324 | 9/1984 | Cook | 405/302 |
| 4,936,714 | 6/1990 | Demircan | 405/302 |

FOREIGN PATENT DOCUMENTS 2096223 10/1982 United Kingdom .

*Primary Examiner*—David H. Corbin

*Attorney, Agent, or Firm*—Young & Thompson

[57] ABSTRACT

A mine roof support comprises a canopy, a base section, hydraulic props for raising and lowering the canopy relative to the base section, a hydraulic valve for supplying hydraulic fluid under pressure to the props via a check valve, and a yield valve connected across the check valve. The yield valve has a valve member movable between a first position in which it co-operates with a valve seat to prevent the release of fluid from the props via the yield valve and a second position in which fluid can be released from the props via the yield valve. One side of the valve member is subjected to fluid pressure downstream of the check valve to urge the valve member towards its second position and the other side of the valve member is acted upon by a spring device to urge the valve member towards its first position. The other side of the valve member and the spring device are also subjected to fluid pressure upstream of the check valve so that more and more of the spring force applied by the spring device is substituted by hydraulic force applied to the other side of the valve member by fluid pressure upstream of the check valve as the latter increases until the fluid pressure acting on the spring device balances the urging force thereof at a nominal yield pressure of the yield valve.

8 Claims, 3 Drawing Sheets

MINE ROOF SUPPORT

INTRODUCTION

This invention relates to a mine roof support.

Known mine roof supports include a roof engageable canopy, a shield section pivotally connected to the goaf end of the canopy, a ground engaging base section, a link arrangement pivotally interconnecting the base section and the shield section, and hydraulic props for raising and lowering the canopy relative to the base section and for setting the canopy against a mine roof. It is common practice to include one or more yield valves in the hydraulic circuit of the roof support so that the props will yield in the event that there is any significant movement in the mine roof.

It is also common practice to supply a number of roof supports which are to be advanced and set in turn from a common supply and the pressure of the supply can therefore vary significantly according to the load on the pump during a particular setting operation.

Conventional yield valves include a valve member which is urged against a seat by a spring. When the valve member is moved away from the seat by fluid pressure overcoming the urging force of the spring, fluid is dumped to low pressure. Thus, the energy that is dissipated across the valve seat is extremely high and in order to avoid premature failure of conventional yield valves, it is important that they should not yield during a setting operation. To this end, the average setting pressure of the props has hitherto been limited to about 80% of the yield pressure of the yield valve to allow for fluctuations in the supply pressure.

This known arrangement suffers from the drawback that the mine roof is not fully restrained to the yield pressure with the result that excessive roof movement can occur causing poor strata control and hence difficult and dangerous mining conditions, particularly when mining thick seams where the props are long and the unrestrained roof movement greatest.

The present invention seeks to mitigate this drawback by providing a mine roof support in which the prop means can be set to a pressure up to the yield pressure without serious risk that this will cause premature failure of the yield valve.

SUMMARY OF THE INVENTION

According to one aspect of the present invention, there is provided a mine roof support comprising a roof engageable canopy, a floor engaging base section, prop means for raising and lowering the canopy relative to the base section and for setting the canopy against a mine roof, means for supplying hydraulic fluid under pressure to the prop means via a check valve (as defined herein), and a yield valve having a valve seat, a valve member movable between a first position in which it co-operates with the valve seat to prevent the release of fluid from the prop means via the yield valve and a second position in which fluid can be released from the prop means via the yield valve, means for subjecting one side of the valve member to fluid pressure downstream of the check valve to urge the valve member towards its second position, spring means acting on the other side of the valve member to urge the valve member towards its first position, and means for subjecting the other side of the valve member and the spring means to fluid pressure upstream of the check valve so that an increasing amount of the spring force applied to the valve member by the spring means is substituted by hydraulic force applied to the other side of the valve member by fluid pressure upstream of the check valve as the latter pressure increases.

The check valve can be a non-return valve or a pilot operated check valve which functions as a non-return valve except when released such as by applying pressure to a pilot line, and the term "check valve" as used herein embraces these valves and any equivalents thereof.

Preferably, the yield valve has a nominal yield pressure which is dictated by the urging force applied to the valve member, in the absence of any fluid pressure upstream of the check valve, by the spring means and wherein the fluid pressure upstream of the check valve acts on the spring means to balance the urging force thereof when the fluid pressure upstream of the yield valve equates to said nominal yield pressure.

The yield valve will yield when fluid pressure downstream of the check valve both exceeds the nominal yield pressure and the fluid pressure upstream of the check valve. This will happen as is required in the event that there is any significant movement in the mine roof. It will also happen if the pressure of the fluid supply to the prop means rises above the nominal yield pressure of the yield valve and then falls, but the pressure drop across the seat of the yield valve will be relatively small and this will not cause any significant damage to the yield valve.

Preferably, the spring means comprises a spring and a force transmitting member for transmitting the urging force of the spring to the valve member, the force transmitting member being slidable within a valve chamber exposed in use to fluid pressure upstream of the check valve and having a part which extends through an opening in a wall of the chamber and which is exposed externally of the chamber to a relatively low reference pressure.

Advantageously, the force transmitting member comprises a plunger having a head portion for transmitting the urging force of the spring to the valve member and a stem portion which extends through the opening in the chamber wall.

Conveniently, the spring is a helical compression spring mounted about the stem of the force transmitting member.

Preferably, sealing means sealingly supports the part/stem of the force transmitting member for slidable movement in said opening and wherein the area bounded by the sealing means is equal to the area bounded by the valve seat, each area being measured in a plane normal to the direction of movement of the valve member.

Conveniently, the valve member is in the form of a piston which is slidably mounted in the valve seat, the valve member having one or more holes in its surface which co-operates with the valve seat, the hole or holes being in use in communication with fluid pressure downstream of the check valve via a passage in the valve member.

According to another aspect of the present invention, there is provided a mine roof support comprising a roof engageable canopy, a floor engaging base section, prop means for raising and lowering the canopy relative to the base section and for setting the canopy against a mine roof, means for supplying hydraulic fluid under pressure to the prop means via one or more check valves (as defined herein), and a yield valve connected across the or each check valve, the yield valve having a valve member and a valve seat, one side of the valve member being subjected in use to fluid pressure downstream of the check valve and the other side of the valve member being subjected in use to fluid pressure upstream of the check valve, the valve member being movable relative to the seat to allow fluid to be released from the prop means when the fluid pressure downstream of the check valve exceeds a predetermined value regardless of the fluid pressure upstream of the check valve, provided the fluid pressure upstream of the check valve does not also exceed said predetermined value.

The invention will now be more particularly described, by way of example, with reference to the accompanying drawings.

DESCRIPTION OF THE PREFERRED EMBODIMENTS

Figure 1:
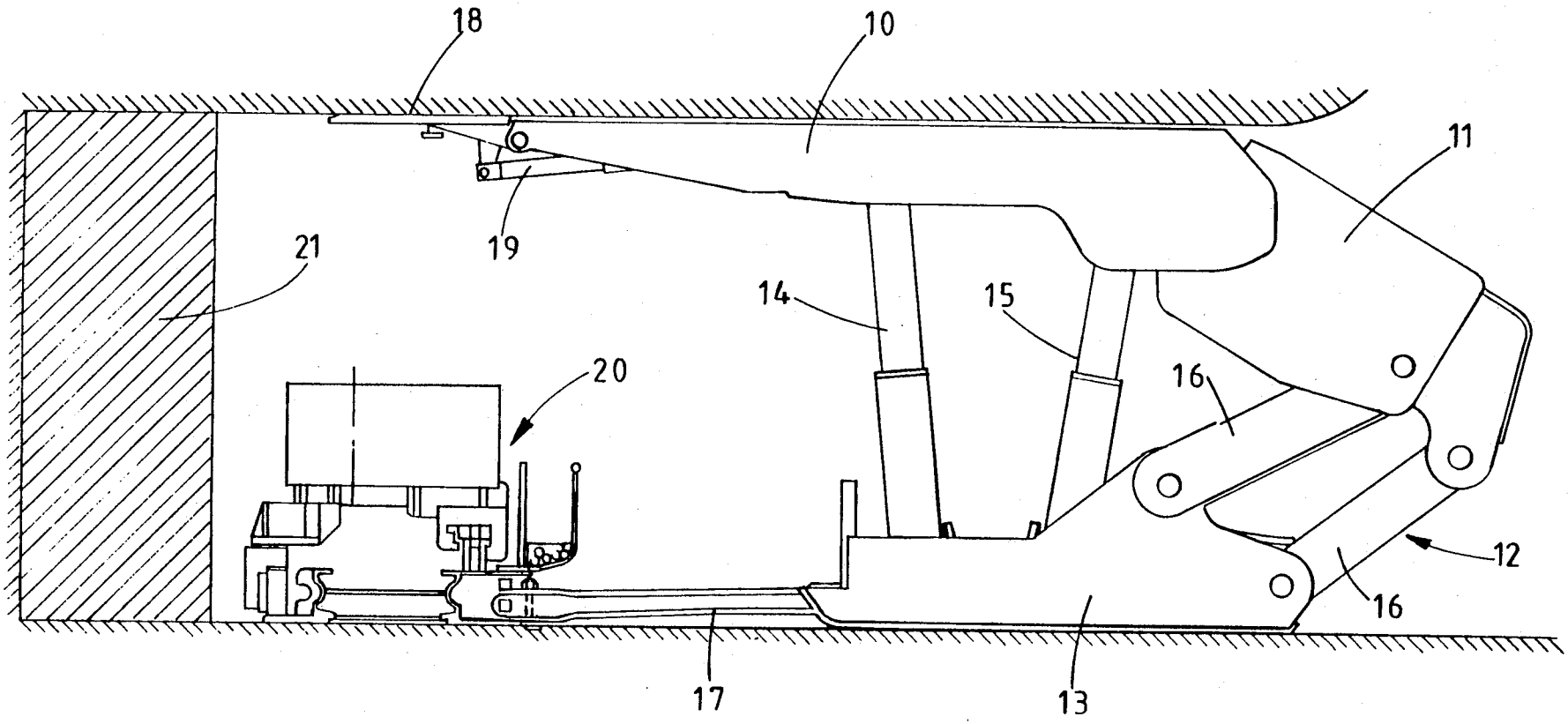
FIG. 1 is a side view of a mine roof support embodying the present invention.

Referring firstly to FIG. 1 of the drawings, the roof support shown therein comprises a canopy 10, a shield section 11, a lemniscate linkage arrangement 12, a base section 13 comprising two spaced apart pontoons, a pair of front hydraulic props 14, and a pair of rear hydraulic props 15.

The shield section 11 is pivotally connected at one end to the rear (goaf) end of the canopy, and the lemniscate linkage arrangement 12, which includes four links 16, is pivotally connected at one end to the other end of the shield section 11, and at the other end to the pontoons making up the base section 13.

The roof support also comprises an advancing mechanism in the space between the two pontoon members, the advancing mechanism comprising a relay bar arrangement 17, and an advancing ram (not shown) connected between the relay bar arrangement 17 and the base section 13.

The rear props 15 are pivotally connected at their lower ends to respective pontoons of the base section 13 and are pivotally connected at their upper ends to the canopy 10 at positions adjacent to the rear end thereof. The front props 14 are also pivotally connected at their lower ends to respective pontoons of the base section 13 and are pivotally connected at their upper ends to the canopy 10 at positions intermediate the ends thereof.

A canopy extension 18, commonly referred to in the art as a tip, is hingedly connected to the front end of the canopy 10 so as to be angularly adjustable relative to the canopy by an hydraulic piston and cylinder unit 19.

The relay bar arrangement is connected to a conveyor 20 which is arranged in juxtaposition to the mine face or seam 21.

Figure 2:
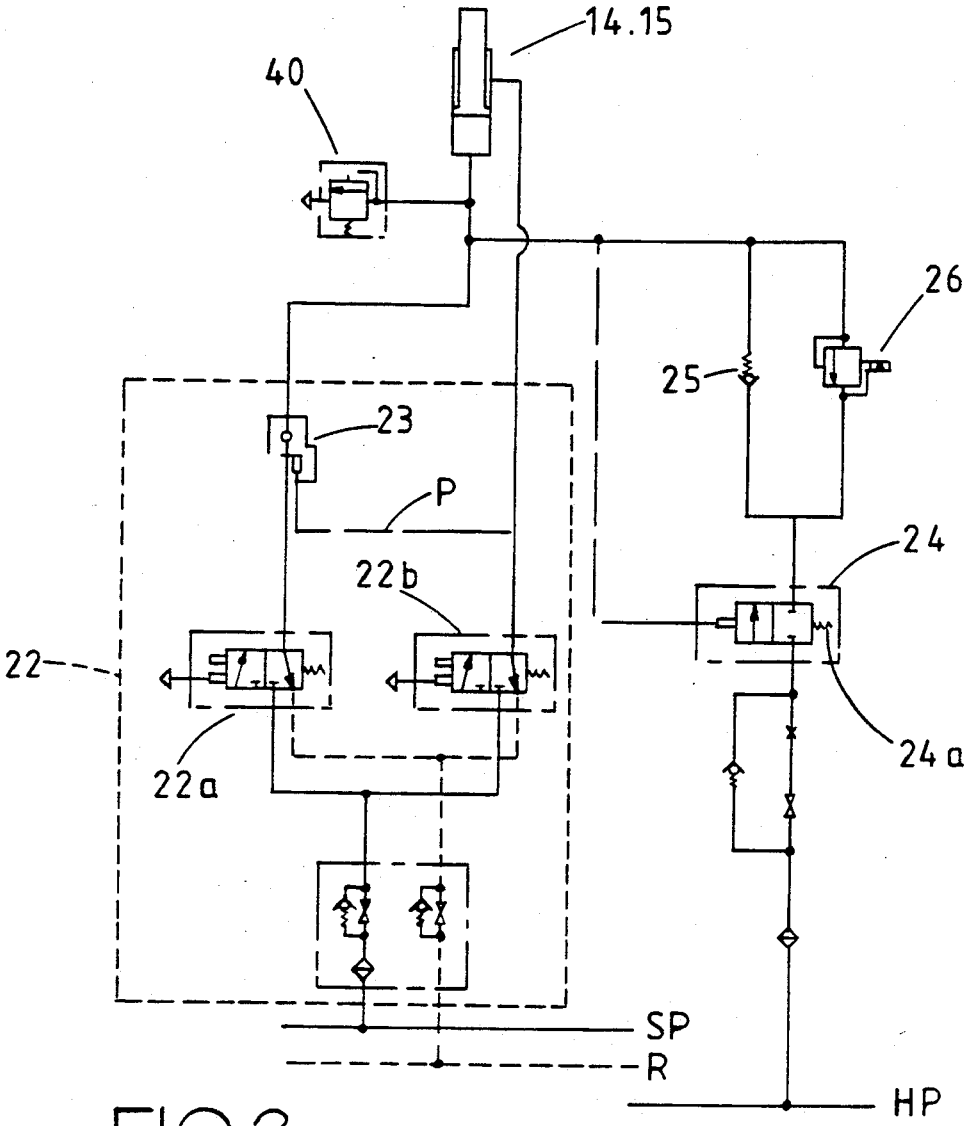
FIG. 2 shows one example of an hydraulic circuit used for operating the hydraulic props of the roof support shown in FIG. 1.

Referring now to FIG. 2, this shows one of the props 14, 15, and an hydraulic circuit for operating that prop. The circuit comprises a known valve arrangement 22 including a set control valve 22*a* for selectively connecting the hydraulic prop 14, 15 to a source of pressurised fluid SP and to a fluid reservoir R, and a release control valve 22*b* connected to the annulus of the prop. The valve arrangement 22 includes a pilot operated check valve 23 which functions as a non-return valve except when released by the application of pressure to a pilot line P.

The hydraulic fluid source SP is common to a number of mine roof supports which are advanced and set in turn. The pressure of the hydraulic fluid source SP is known as the system pressure, and is typically of the order of 3000 psi (20600kN/m$^2$).

This system pressure can drop due to a large drain on the source SP as the roof supports are advanced and set with the result that the roof supports may be set at somewhat below their intended setting value. To prevent this happening, there is also a guaranteed set valve 24 which, when operated, connects the prop 14, 15 to a source of hydraulic fluid HP, supplied by a small capacity pump at a pressure higher than the system pressure. The valve 24 is a pilot operated valve which is urged towards a closed condition by a spring 24*a* and which is moved to an open condition by fluid pressure acting on a pilot piston against the urging force of the spring. The valve 24 is operable in response to the pressure in the hydraulic prop 14, 15 and moves to an open condition when the pressure in the prop exceeds a predetermined value. The valve 24 is connected to the hydraulic prop 14, 15 via a check valve in the form of a non-return valve 25 and a yield valve 26 is connected across the non-return valve 25. There is also a safety valve 40.

Figure 3:
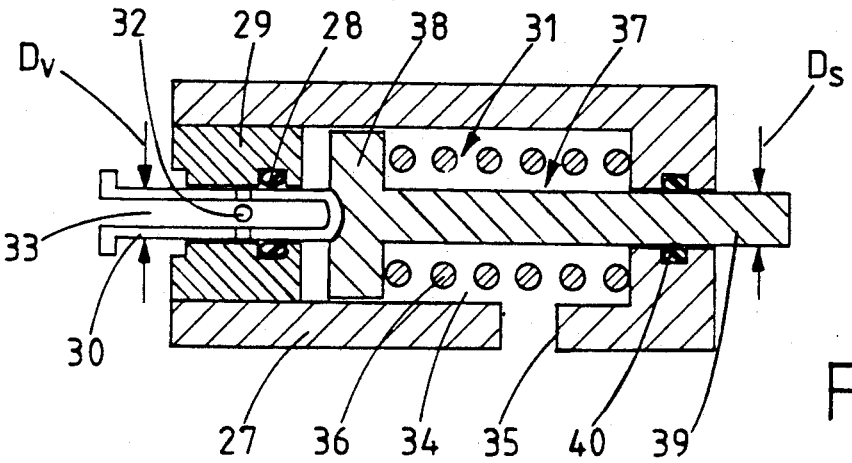
FIG. 3 is a sectional view of one embodiment of the yield valve of FIG. 2, shown on an enlarged scale.

The yield valve 26 will now be more particularly described with reference to FIG. 3. This valve 26 comprises a valve body 27 having a valve seat 28 supported by a seat carrier 29 at one end of the valve body 27. The seat carrier 29 is in the form of a plug having a cylindrical through-bore therein and the seat 28 is in the form of an O-ring which is mounted in an annular groove in the wall of the through-bore.

The valve 26 also comprises a valve member 30 and a spring device 31. The valve member 30 is in the form of an elongate piston which is slidably mounted in the seat 28. The valve member 30 has one or more holes 32 in its peripheral surface and these holes 32 communicate with a cavity 33 within the valve member 30. The cavity 33 communicates with hydraulic fluid downstream of the non-return valve 25 (i.e. with the fluid pressure in the prop 14, 15), and a valve chamber 34 in the valve body 27 communicates with hydraulic fluid upstream of the non-return valve 25 via a port 35.

The spring device 31 comprises a helical compression spring 36 mounted within the valve chamber 34 and a force transmitting member in the form of a plunger 37 which is urged towards the valve member 30 by the spring 36. The plunger 37 has a disc-shaped head 38 which is loosely slidable in the valve chamber 34 and a cylindrical stem 39 which projects from the head 38 away from the valve member 30 and through an opening in the end of the valve body 27 so that the outer end of the stem 39 is exposed to atmospheric pressure, or some other appropriate relatively low reference pressure. An O-ring seal 40 provides a seal between the valve body 27 and the stem 39.

The diameter $D_s$ of the stem 39 is equal to the diameter $D_v$ of the valve member 30 and the area bounded by the valve seat 28 is equal to the area bounded by the seal 40. Thus, the nominal yield pressure of the valve will be dictated by the full urging force of the spring 36 and the fluid pressure upstream of the non return valve 25 will balance the urging force of the spring when said upstream pressure equates to the nominal yield pressure.

With this yield valve, the average pressure of fluid supplied from the source HP can be at (or close to) yield pressure without risking premature failure of the yield valve.

In order to set the canopy, the valve arrangement 22 is first operated so that pressurised fluid is supplied to the prop 14, 15 from the source SP. The canopy 10 will rise and make contact with the mine roof. Provided the mine roof is sound, the canopy 10 will set against the roof at a pressure corresponding to the system pressure supplied from the source SP. Although, the system pressure may be less than its full value owing to the large drain on the source SP, it will be more than adequate to open the guaranteed set valve 24 and there will then be a constant supply of high pressure fluid from source HP to the prop 14, 15, via the non-return valve 25. Hydraulic fluid will enter the valve chamber 34 via the port 35 and will pass around the head 38 of the plunger 37. The hydraulic fluid within the valve chamber 34 acts on the head 38 of the plunger 37 to provide a net force which opposes the urging force of the spring 36 and the hydraulic fluid within the valve chamber 34 applies an equal and opposite force to the valve member 30. The valve member 30 is also acted upon by the pressure of hydraulic fluid downstream of the non-return valve 25 and the forces applied to opposite sides of the valve member 30 by fluid pressure upstream and downstream of the non-return valve 25 will be equal and opposite provided that the upstream and downstream pressures are also equal. Thus, whilst the upstream and downstream pressures are equal the hydraulic pressure acting on opposite sides of the valve member 30 will be balanced, and the urging force of the spring device 31 will progressively decrease to zero as the upstream pressure increases to the nominal yield pressure of the valve 26. Thus, if the hydraulic prop 14, 15 is set to the yield pressure of the valve 26, fluid pressure upstream of the non-return valve 25 will act on the spring device 31 so that this spring device applies no load whatsoever to the valve member 30. The valve member will remain closed as a result of friction, but if the mine roof moves to increase the pressure in the prop 14, 15, the valve member 30 will move to discharge fluid from the prop 14, 15 as the pressure downstream of the non-return valve 25 will be greater than the pressure upstream of the non-return valve 25. If the pressure of source HP rises above the nominal yield pressure of the valve 26 and then falls, the valve 26 will yield but the pressure drop across the seat 28 will be low and there will be no significant damage to the yield valve. If the pressure of source HP is below the nominal yield pressure of the valve 26, the spring device 34 will still apply some force to the valve member 30 and the yield valve will only release fluid from the prop 14, 15 when the fluid pressure in the prop exceeds the nominal yield pressure of the valve 26.

If the pressure of the source HP falls to zero, i.e. if the pump is turned off, the yield valve 26 will act in conventional manner and will release fluid from the prop when the fluid pressure therein exceeds the nominal yield pressure of the valve 26 by overcoming the full urging force of the spring device 31.

Only one prop 14, 15 is shown in FIG. 2. The circuit shown in FIG. 2 may service all props 14, 15 simultaneously or, by way of example, the two front props 14 could be serviced by one hydraulic circuit and the two rear props 15 by a similar but separate hydraulic circuit.

Also, the props 14, 15 could be set to the system pressure by supplying the guaranteed set valve 24 from the source SP instead of the separate high pressure source HP. In this case, the full system pressure may be equivalent to the yield pressure of the valve 26.

Figure 4:
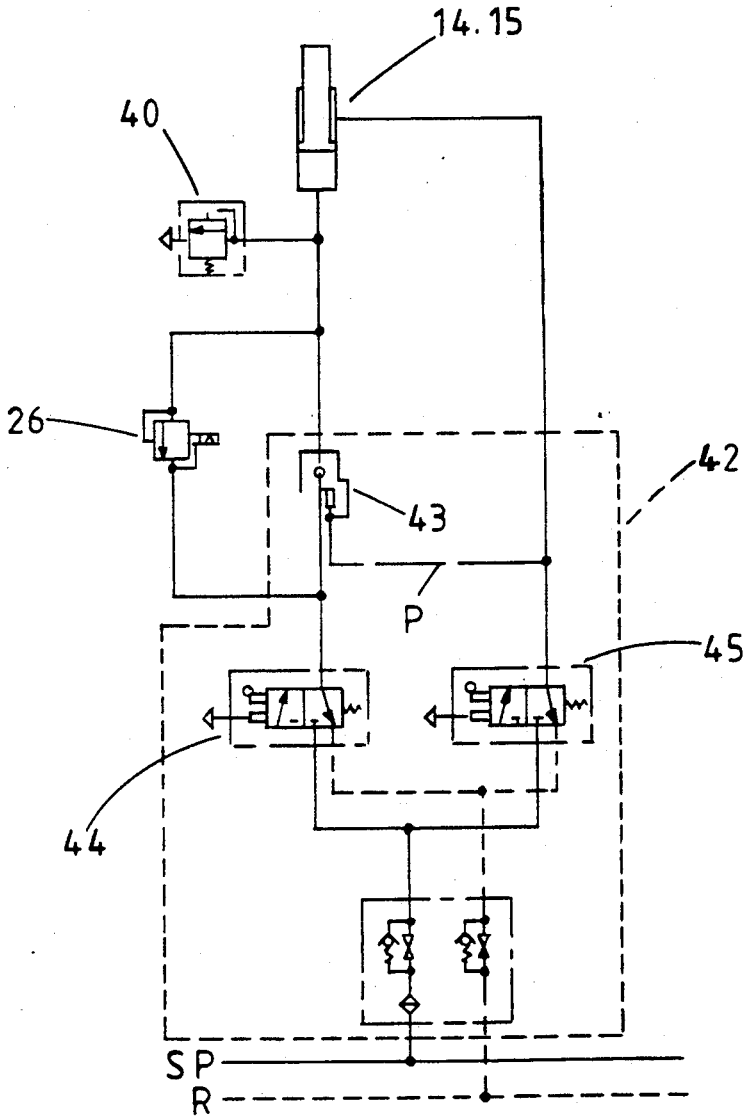
FIG. 4 shows another example of an hydraulic circuit used for operating the hydraulic props of the roof support shown in FIG. 1.

Referring now to FIG. 4, this shows an alternative hydraulic circuit for operating the prop 14, 15. This circuit can be used, for example, when the roof supports are advanced and set under electronic control. The circuit comprises a known valve arrangement 42 for selectively connecting the hydraulic prop 14, 15 to a source of pressurised fluid SP and to a fluid reservoir R. The valve arrangement 42 includes a pilot operated check valve 43 which functions as a non-return valve except when released by the application of pressure to a pilot line P. When setting the roof support, a set control valve 44 is held open, under electronic control, for long enough to ensure that the prop 14, 15 is set against the mine roof to (or substantially to) full system pressure. No guaranteed set valve is provided, and the yield valve 26 is connected across the check valve 43. A further control valve 45 can be held open, under electronic control, to supply pressure to the annulus of the prop and to apply a pilot signal to the check valve 43 to release the latter when it is required to lower the canopy 10.

The yield valve 26 of the circuit shown in FIG. 4 operates in similar manner to the yield valve of the circuit shown in FIG. 2, although the prop 14, 15 is set to full system pressure which may, in this case, be equivalent to the nominal yield pressure of the valve 26.

The above embodiments are given by way of example only and various modifications will be apparent to persons skilled in the art without departing from the scope of the invention. For example, the helical compression spring 31 could be replaced by a gas spring.

What is claimed is:

1. A mine roof support comprising a roof engageable canopy, a floor engaging base section, prop means for raising and lowering the canopy relative to the base section and for setting the canopy against a mine roof, a check valve (as defined herein), means for supplying hydraulic fluid under pressure to the prop means via the check valve, and a yield valve having a valve seat, a valve member movable between a first position in which it co-operates with the valve seat to prevent the release of fluid from the prop means via the yield valve and a second position in which fluid can be released from the prop means via the yield valve, means for subjecting one side of the valve member to fluid pressure downstream of the check valve to urge the valve member towards its second position, spring means acting on the other side of the valve member to urge the valve member towards its first position, and means for subjecting the other side of the valve member and the spring means to fluid pressure upstream of the check valve so that an increasing amount of the spring force applied to the valve member by the spring means is substituted by hydraulic force applied to the other side of the valve member by fluid pressure upstream of the check valve as the latter increases.

2. A mine roof support as claimed in claim 1, wherein the yield valve has a nominal yield pressure which is dictated by the urging force applied to the valve member, in the absence of any fluid pressure upstream of the check valve, by the spring means and wherein the fluid pressure upstream of the check valve acts on the spring means to balance the urging force thereof when the fluid pressure upstream of the yield valve equates to said nominal yield pressure.

3. A mine roof support as claimed in claim 1, wherein the spring means comprises a spring and a force transmitting member for transmitting the urging force of the spring to the valve member, the force transmitting member being slidable within a valve chamber exposed in use to fluid pressure upstream of the check valve and having a part which extends through an opening in a wall of the chamber and which is exposed externally of the chamber to a relatively low reference pressure.

4. A mine roof support as claimed in claim 3, wherein the force transmitting member comprises a plunger having a head portion for transmitting the urging force of the spring to the valve member and a stem portion which extends through the opening in the chamber wall.

5. A mine roof support as claimed in claim 4, wherein the spring is a helical compression spring mounted about the stem of the force transmitting member.

6. A mine roof support as claimed in claim 3, wherein sealing means sealingly supports the said part of the force transmitting member for slidable movement in said opening and wherein the area bounded by the sealing means is equal to the area bounded by the valve seat, each area being measured in a plane normal to the direction of movement of the valve member.

7. A mine roof support as claimed in claim 1, wherein the valve member is in the form of a piston which is slidably mounted in the valve seat, the valve member having one or more holes in its surface which co-operates with the valve seat, the hole or holes being in use in communication with fluid pressure downstream of the check valve via a passage in the valve member.

8. A mine roof support comprising a roof engageable canopy, a floor engaging base section, prop means for raising and lowering the canopy relative to the base section and for setting the canopy against a mine roof, a check valve (as defined herein), means for supplying hydraulic fluid under pressure to the prop means via the check valve, and a yield valve connected across the check valve, the yield valve having a valve member and a valve seat, one side of the valve member being subjected in use to fluid pressure downstream of the check valve and the other side of the valve member being subjected in use to fluid pressure upstream of the check valve, the valve member being movable relative to the seat to allow fluid to be released from the prop means when the fluid pressure downstream of the check valve exceeds a predetermined value regardless of the fluid pressure upstream of the check valve, provided the fluid pressure upstream of the check valve does not also exceed said predetermined value.

* * * * *